US011845283B2

(12) United States Patent
Yamaguchi et al.

(10) Patent No.: US 11,845,283 B2
(45) Date of Patent: Dec. 19, 2023

(54) LIQUID EJECTING APPARATUS AND METHOD FOR CONTROLLING LIQUID EJECTING APPARATUS

(71) Applicant: Seiko Epson Corporation, Tokyo (JP)

(72) Inventors: Masanobu Yamaguchi, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 129 days.

(21) Appl. No.: 17/468,201

(22) Filed: Sep. 7, 2021

(65) Prior Publication Data

US 2022/0072861 A1 Mar. 10, 2022

(30) Foreign Application Priority Data

Sep. 8, 2020 (JP) ..... 2020-150390

(51) Int. Cl.
*B41J 2/165* (2006.01)
*B41J 2/045* (2006.01)

(52) U.S. Cl.
CPC ..... *B41J 2/16535* (2013.01); *B41J 2/04553* (2013.01); *B41J 2/04566* (2013.01); *B41J 2002/16558* (2013.01)

(58) Field of Classification Search
CPC ..... B41J 2/16535; B41J 2/16517; B41J 2/04553; B41J 2/04566; B41J 2002/16558; B41J 2002/1655
See application file for complete search history.

(56) References Cited

U.S. PATENT DOCUMENTS

| | | | |
|---|---|---|---|
| 2003/0189614 | A1 | 10/2003 | Steinfield et al. |
| 2013/0120495 | A1 | 5/2013 | Nakamura et al. |
| 2013/0257980 | A1 | 10/2013 | Ibe et al. |
| 2014/0368577 | A1 | 12/2014 | Ibe et al. |

(Continued)

FOREIGN PATENT DOCUMENTS

| | | |
|---|---|---|
| JP | 2003-300329 | 10/2003 |
| JP | 2013-103378 | 5/2013 |
| JP | 2013-226798 | 11/2013 |

(Continued)

*Primary Examiner* — Kristal Feggins
(74) *Attorney, Agent, or Firm* — WORKMAN NYDEGGER

(57) ABSTRACT

A liquid ejecting apparatus includes a liquid ejecting portion configured to eject a liquid, a liquid collection device including a band-shaped member configured to come into contact with the liquid ejecting portion to wipe a liquid attached to the liquid ejecting portion, and a winding portion configured to wind up the band-shaped member, a temperature/humidity sensor configured to acquire temperature/humidity information related to a temperature and a humidity around the liquid collection device, and a control portion configured to cause the band-shaped member to come into contact with the liquid ejecting portion to wipe the liquid, and then cause the winding portion to wind up the band-shaped member. The control portion determines, based on the temperature/humidity information acquired by the temperature/humidity sensor, a winding length of the band-shaped member wound by the winding portion after the band-shaped member wipes the liquid.

6 Claims, 13 Drawing Sheets

(56) References Cited

U.S. PATENT DOCUMENTS

2019/0255854 A1 8/2019 Asano et al.

FOREIGN PATENT DOCUMENTS

| | | | | | |
|---|---|---|---|---|---|
| JP | 2015-000509 | | | 1/2015 | |
| JP | 2019-119137 | | | 7/2019 | |
| JP | 2019-142145 | | | 8/2019 | |
| JP | 2021146523 | A | * | 9/2021 | ..... B41J 2/16544 |

* cited by examiner

T

| TEMPERATURE [°C] / HUMIDITY [%] | 0～20 | ～30 | ～40 |
|---|---|---|---|
| 0～30 | B1 | B2 | B3 |
| ～60 | B4 | B5 | B6 |
| ～100 | B7 | B8 | B9 |

FIG. 9

LIQUID EJECTING APPARATUS AND METHOD FOR CONTROLLING LIQUID EJECTING APPARATUS

The present application is based on, and claims priority from JP Application Serial Number 2020-150390, filed Sep. 8, 2020, the disclosure of which is hereby incorporated by reference herein in its entirety.

BACKGROUND

1. Technical Field

The present disclosure relates to a liquid ejecting apparatus and a method for controlling a liquid ejecting apparatus.

2. Related Art

For example, as in JP-A-2003-300329, a printer that ejects ink from a print head to perform printing is known. The printer includes a cleaning device that cleans the print head by using a web as a band-shaped member. The cleaning device slides the web supplied from a web supply source with the print head, and causes the web to absorb ink. Subsequently, the cleaning device can perform cleaning in an unused portion next time by winding up the web by a predetermined amount.

As time goes by, ink wiped out by the band-shaped member such as the web also spreads, by an amount according to a surrounding environment such as the temperature and humidity, to an unused portion that is not in contact with the print head. Thus, when the band-shaped member is wound up after the cleaning, it is necessary to wind up the band-shaped member by the amount in consideration of the amount of the spread of the ink. However, with a configuration in which the band-shaped member is always wound up by a fixed amount, when the printer having the configuration is used under an environment where the ink does not spread very much, there is a problem that the band-shaped member that does not absorb the ink is wound up in excess.

SUMMARY

A liquid ejecting apparatus includes a liquid ejecting portion configured to eject a liquid, a wiping portion including a band-shaped member configured to come into contact with the liquid ejecting portion to wipe a liquid attached to the liquid ejecting portion, and a winding unit configured to wind up the band-shaped member, a temperature/humidity information acquisition portion configured to acquire temperature/humidity information related to a temperature and a humidity around the wiping portion, and a control portion configured to cause the band-shaped member to contact the liquid ejecting portion to wipe the liquid, and then cause the band-shaped member to be wound by the winding unit, where the control portion determines, based on the temperature/humidity information acquired by the temperature/humidity information acquisition portion, a winding length of the band-shaped member wound by the winding unit after the band-shaped member wipes the liquid.

A method for controlling a liquid ejecting apparatus is a method for controlling a liquid ejecting apparatus including a liquid ejecting portion configured to eject a liquid, a wiping portion including a band-shaped member configured to come into contact with the liquid ejecting portion to wipe a liquid attached to the liquid ejecting portion, and a winding portion configured to wind up the band-shaped member, and a temperature/humidity information acquisition portion configured to acquire temperature/humidity information related to a temperature and a humidity around the wiping portion, the liquid ejecting apparatus being configured to cause the band-shaped member to come into contact with the liquid ejecting portion to perform wiping, and then cause the winding portion to wind up the band-shaped member, and the method includes determining, based on the temperature/humidity information acquired by the temperature/humidity information acquisition portion, a winding length of the band-shaped member wound by the winding portion after the band-shaped member wipes the liquid.

BRIEF DESCRIPTION OF THE DRAWINGS

FIG. 9 is a diagram illustrating a table for determining a winding length.

DESCRIPTION OF EXEMPLARY EMBODIMENTS

Figure 1:
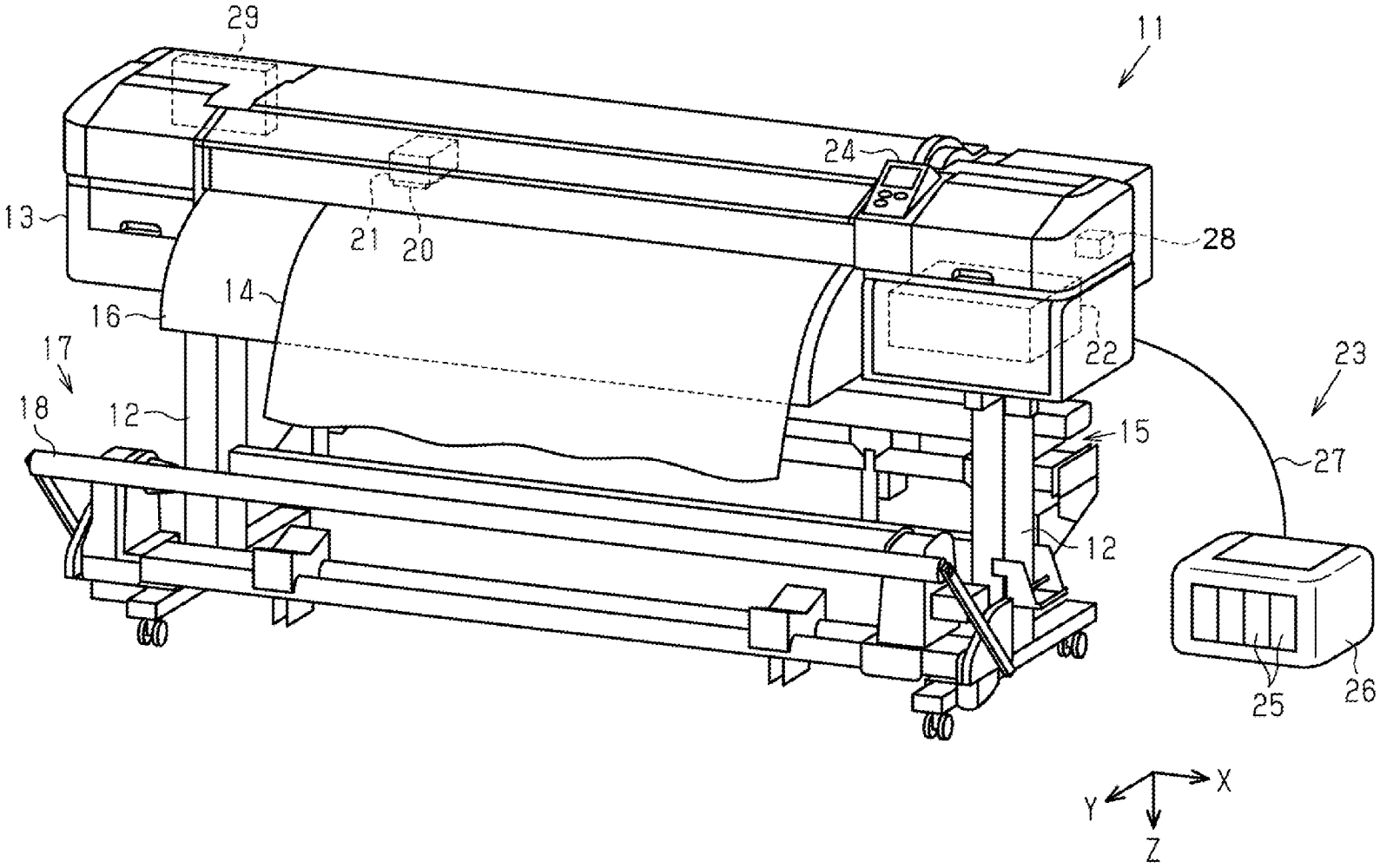
FIG. 1 is a perspective view of one exemplary embodiment of a liquid ejecting apparatus.

One exemplary embodiment of a liquid ejecting apparatus and a method for controlling the liquid ejecting apparatus will be described below with reference to the drawings. A liquid ejecting apparatus 11 is, for example, an ink jet-type printer that ejects ink, which is an example of a liquid, onto a medium 14 such as a sheet to perform printing.

In the drawings, assuming that the liquid ejecting apparatus 11 is placed on a horizontal plane, a direction of gravity is indicated by a Z axis, and directions along the horizontal plane are indicated by an X axis and a Y axis. The X, Y, and Z axes are orthogonal to each other. In the following description, a direction along the X axis is also referred to as a width direction X, a direction along the Y axis is also referred to as a depth direction Y, and a direction along the Z axis is also referred to as a gravitational direction Z.

As illustrated in FIG. 1, the liquid ejecting apparatus 11 may include a pair of legs 12 and a housing 13 assembled onto the legs 12. The liquid ejecting apparatus 11 may include a feeding portion 15 that unwinds and feeds the medium 14 wound in a roll shape, a guide portion 16 that guides the medium 14 discharged from the housing 13, and a recovery portion 17 that winds up and recovers the medium 14. The liquid ejecting apparatus 11 may include a tension providing mechanism 18 for providing tension to the medium 14 recovered by the recovery portion 17.

The liquid ejecting apparatus 11 includes a liquid ejecting portion 20 capable of ejecting a liquid, a carriage 21 that moves the liquid ejecting portion 20, and a maintenance unit 22 that performs maintenance of the liquid ejecting portion 20. The liquid ejecting apparatus 11 may include a liquid supply device 23 that supplies a liquid to the liquid ejecting portion 20, and an operation panel 24 operated by a user. The carriage 21 reciprocates the liquid ejecting portion 20 along the X axis. The liquid ejecting portion 20 ejects a liquid supplied through the liquid supply device 23 while moving, to perform printing on the medium 14.

The liquid supply device 23 includes a mounting portion 26 on which a plurality of liquid accommodation bodies 25 that accommodates a liquid are detachably mounted, and a supply flow path 27 that supplies a liquid from the liquid accommodation body 25 mounted on the mounting portion 26 to the liquid ejecting portion 20.

The liquid ejecting apparatus 11 includes a temperature/humidity sensor 28 that detects the temperature and humidity, and a control portion 29 that controls an operation of the liquid ejecting apparatus 11. The control portion 29 is configured to include a CPU, a memory, and the like, for example. The control portion 29 controls the liquid ejecting portion 20, the liquid supply device 23, the maintenance unit 22, and the like by executing a program stored in the memory by the CPU. The temperature/humidity sensor 28 is disposed inside the liquid ejecting apparatus 11, specifically, near the maintenance unit 22 inside the housing 13. The temperature/humidity sensor 28 detects the temperature and humidity around the maintenance unit 22, and transmits the detection result as temperature/humidity information to the control portion 29. In other words, the temperature/humidity information is information related to a temperature and a humidity around the maintenance unit 22, and the temperature/humidity sensor 28 corresponds to a temperature/humidity information acquisition portion that acquires the temperature/humidity information.

Figure 2:
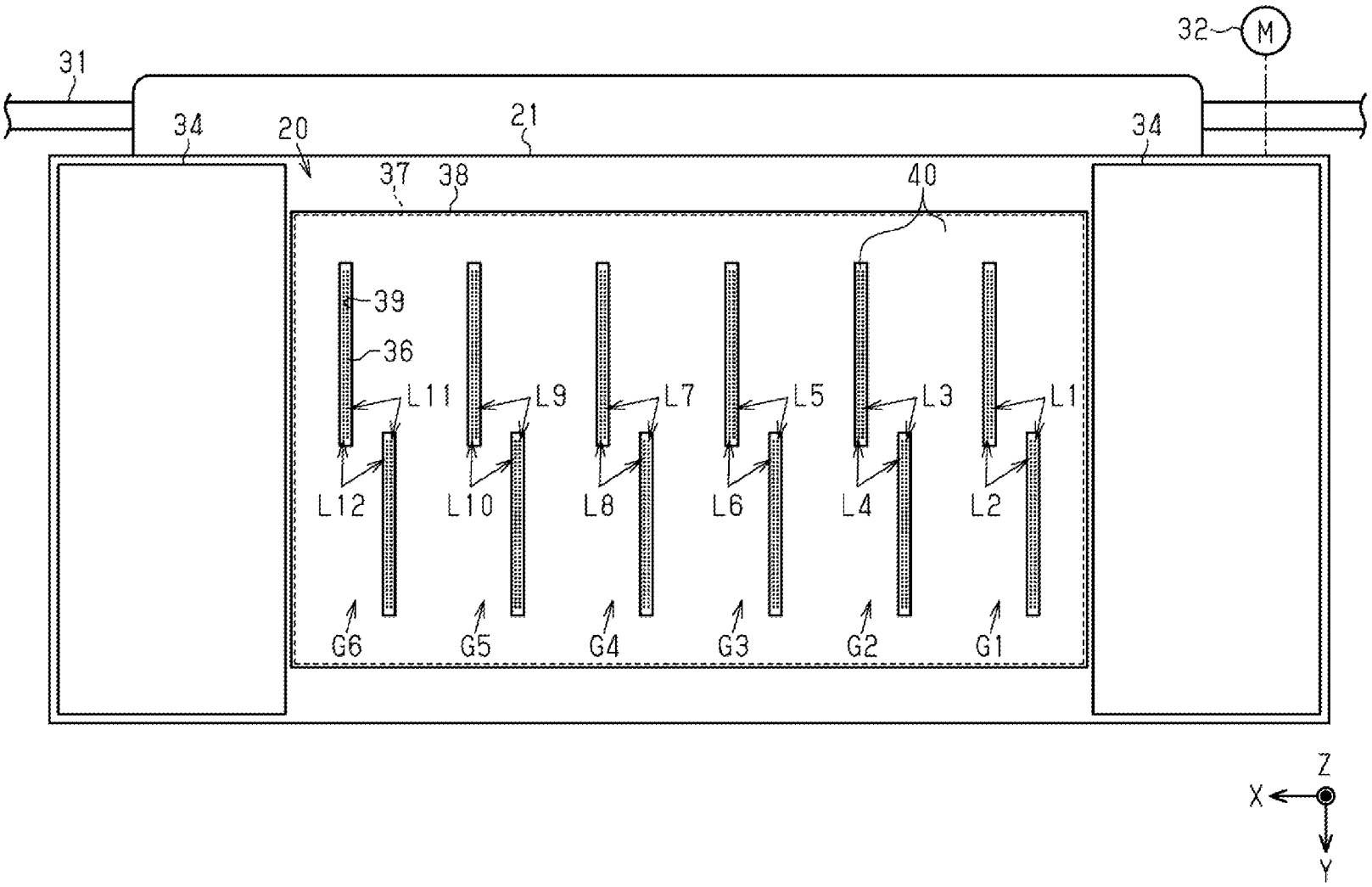
FIG. 2 is a schematic bottom view of a liquid ejecting portion and a carriage.

As illustrated in FIG. 2, the liquid ejecting apparatus 11 may include a guide shaft 31 that supports the carriage 21, and a carriage motor 32 that moves the carriage 21. The guide shaft 31 extends in the width direction X. The control portion 29 reciprocates the carriage 21 and the liquid ejecting portion 20 along the guide shaft 31 by controlling driving of the carriage motor 32.

The liquid ejecting apparatus 11 may include a wind regulating portion 34 held in a lower portion of the carriage 21. When the wind regulating portion 34 is provided on both sides of the liquid ejecting portion 20 in the width direction X, an airflow around the liquid ejecting portion 20 that reciprocates along the X axis can be easily regulated.

The liquid ejecting portion 20 may include a nozzle forming member 37 in which a plurality of nozzles 36 are formed, and a cover member 38 that covers a part of the nozzle forming member 37. The cover member 38 is formed of a metal such as stainless steel, for example. A plurality of through holes 39 penetrating the cover member 38 in the gravitational direction Z are formed in the cover member 38. The cover member 38 covers a side on which the nozzle 36 is formed in the nozzle forming member 37 so as to expose the nozzle 36 from the through hole 39. A nozzle surface 40 is formed by including the nozzle forming member 37 and the cover member 38. Specifically, the nozzle surface 40 is formed of the nozzle forming member 37 exposed from the through hole 39, and the cover member 38, and the nozzle 36 that ejects a liquid is formed thereon.

In the liquid ejecting portion 20, many openings of the nozzles 36 that eject a liquid are arranged at a fixed interval in one direction. The plurality of nozzles 36 constitute a nozzle row. In the present exemplary embodiment, the openings of the nozzles 36 are arranged in the depth direction Y, and constitute a first nozzle row L1 to a twelfth nozzle row L12. The nozzles 36 constituting one nozzle row eject the same type of liquid. Of the nozzles 36 each constituting one nozzle row, the nozzle 36 located at the back in the depth direction Y and the nozzle 36 located at the front in the depth direction Y are formed so as to be displaced in the width direction X.

Two rows of the first nozzle row L1 to the twelfth nozzle row L12 are arranged adjacent to each other in the width direction X. In the present exemplary embodiment, two nozzle rows arranged adjacent to each other are referred to as a nozzle group. In the liquid ejecting portion 20, a first nozzle group G1 to a sixth nozzle group G6 are disposed at a constant interval in the width direction X.

Specifically, the first nozzle group G1 includes the first nozzle row L1 that ejects magenta ink, and the second nozzle row L2 that ejects yellow ink. The second nozzle group G2 includes the third nozzle row L3 that ejects cyan ink, and the fourth nozzle row L4 that ejects black ink. The third nozzle group G3 includes the fifth nozzle row L5 that ejects light cyan ink, and the sixth nozzle row L6 that ejects light magenta ink. The fourth nozzle group G4 includes the seventh nozzle row L7 and the eighth nozzle row L8 that eject a process liquid. The fifth nozzle group G5 includes the ninth nozzle row L9 that ejects black ink, and the tenth nozzle row L10 that ejects cyan ink. The sixth nozzle group G6 includes the eleventh nozzle row L11 that ejects yellow ink, and the twelfth nozzle row L12 that ejects magenta ink.

Next, the maintenance unit 22 will be described.

Figure 3:
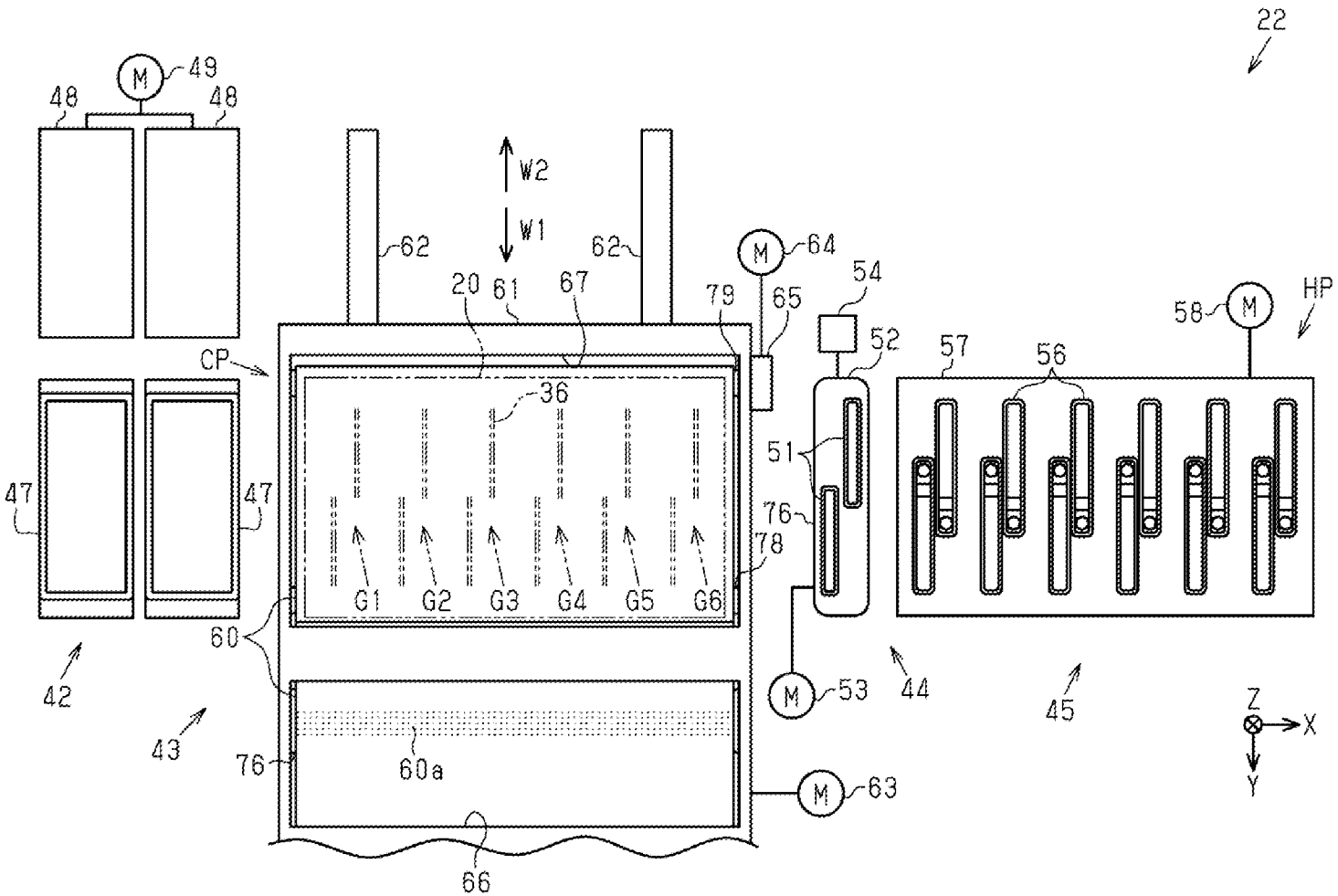
FIG. 3 is a schematic plan view of a maintenance unit.

As illustrated in FIG. 3, the maintenance unit 22 includes a flushing device 42 arranged in the width direction X, a liquid collection device 43 as a wiping portion, a suction device 44, and a capping device 45. A home position HP of the liquid ejecting portion 20 is located above the capping device 45. The home position HP is a start point of a movement of the liquid ejecting portion 20. A cleaning position CP of the liquid ejecting portion 20 is located above the liquid collection device 43. In FIG. 3, the liquid ejecting portion 20 located in the cleaning position CP is indicated by a double-dashed line.

The flushing device 42 accommodates a liquid ejected from the liquid ejecting portion 20 by flushing. The flashing is maintenance that ejects a liquid as a waste liquid for the purpose of preventing and eliminating clogging of the nozzle 36.

The flushing device 42 includes a liquid accommodation portion 47 that accommodates a liquid ejected by the liquid ejecting portion 20 for the flushing, a lid member 48 for covering an opening of the liquid accommodation portion 47, and a lid motor 49 that moves the lid member 48. The flushing device 42 may include a plurality of the liquid accommodation portions 47 and a plurality of the lid members 48. The control portion 29 may select the liquid accommodation portion 47 depending on a type of a liquid. The flushing device 42 according to the present exemplary embodiment includes two liquid accommodation portions 47, one of the liquid accommodation portions 47 accommodates a plurality of color inks ejected by the flushing from the liquid ejecting portion 20, and the other liquid accommodation portion 47 accommodates a process liquid ejected by the flushing from the liquid ejecting portion 20. The liquid accommodation portion 47 may accommodate a moisture liquid.

The lid member 48 moves, by driving of the lid motor 49, between a covering position (not illustrated) in which the opening of the liquid accommodation portion 47 is covered, and an exposing position illustrated in FIG. 3 in which the opening of the liquid accommodation portion 47 is exposed. When the flushing is not performed, the lid member 48 moves to the covering position to suppress drying of the accommodated moisture liquid and the accommodated liquid.

The suction device 44 includes a suction cap 51, a suction holding body 52, a suction motor 53 that reciprocates the suction holding body 52 along the Z axis, and a decompression mechanism 54 for reducing pressure inside the suction cap 51. The suction motor 53 moves the suction cap 51 between a contact position and a retraction position. The contact position is a position in which the suction cap 51 is in contact with the liquid ejecting portion 20 and surrounds the nozzle 36. The retraction position is a position in which the suction cap 51 is separated from the liquid ejecting portion 20. The suction cap 51 may be configured to collectively surround all the nozzles 36, may be configured to surround at least one nozzle group, or may be configured to surround some nozzles 36 of the nozzles 36 constituting the nozzle group. The suction device 44 according to the present exemplary embodiment surrounds one nozzle group of the first nozzle group G1 to the sixth nozzle group G6 by two suction caps 51.

In the liquid ejecting apparatus 11, the liquid ejecting portion 20 may be located above the suction device 44, the suction caps 51 may be located in the contact position and surround one nozzle group, and suction cleaning that emits a liquid from the nozzles 36 by reducing pressure inside the suction caps 51. In other words, the suction device 44 may accommodate a liquid emitted by the suction cleaning.

The capping device 45 includes an idle cap 56, an idle holding body 57, and an idle motor 58 that reciprocates the idle holding body 57 along the Z axis. The idle holding body 57 and the idle cap 56 move upward or downward by driving of the idle motor 58. The idle cap 56 moves from a separated position that is a lower position to a capping position that is an upper position, and contacts the liquid ejecting portion 20 stopping in the home position HP.

The idle cap 56 located in the capping position surrounds the openings of the nozzles 36 constituting the first nozzle group G1 to the sixth nozzle group G6. In this way, maintenance in which the idle cap 56 surrounds the openings of the nozzles 36 is referred to as idle capping. The idle capping is a kind of capping. The idle capping suppresses drying of the nozzles 36.

The idle cap 56 may be configured to collectively surround all the nozzles 36, may be configured to surround at least one nozzle group, or may be configured to surround some nozzles 36 of the nozzles 36 constituting the nozzle group.

Next, the liquid collection device 43 will be described.

As illustrated in FIG. 3, the liquid collection device 43 includes a band-shaped member 60 capable of absorbing a liquid. The liquid collection device 43 may include a case 61 that accommodates the band-shaped member 60, a pair of rails 62 extending along the Y axis, a wiping motor 63, a winding motor 64, and a power transmission mechanism 65 for transmitting power of the winding motor 64. The case 61 includes a first opening 66 and a second opening 67 that expose the band-shaped member 60. When a size of the band-shaped member 60 in the width direction X is equal to or greater than a size of the nozzle surface 40, maintenance can be efficiently performed on the liquid ejecting portion 20.

As illustrated in FIG. 3, the case 61 reciprocates on the rail 62 along the Y axis by power of the wiping motor 63. Specifically, the case 61 moves between a standby position illustrated in FIG. 4 and an accommodation position illustrated in FIG. 3. When the wiping motor 63 is driven in a normal rotation, the case 61 located in the standby position moves in a first wiping direction W1 parallel to the Y axis, and is directed to the accommodation position. When the wiping motor 63 is driven in a reverse rotation, the case 61 located in the accommodation position moves in a second wiping direction W2 opposite to the first wiping direction W1, and is directed to the standby position.

The liquid ejecting apparatus 11 may wipe the liquid ejecting portion 20 in at least one process of a process in which the case 61 moves from the standby position to the accommodation position and a process in which the case 61 moves from the accommodation position to the standby position. The wiping is maintenance in which the band-shaped member 60 is moved in contact with the nozzle surface 40 to wipe a liquid attached to the nozzle surface 40.

Figure 4:
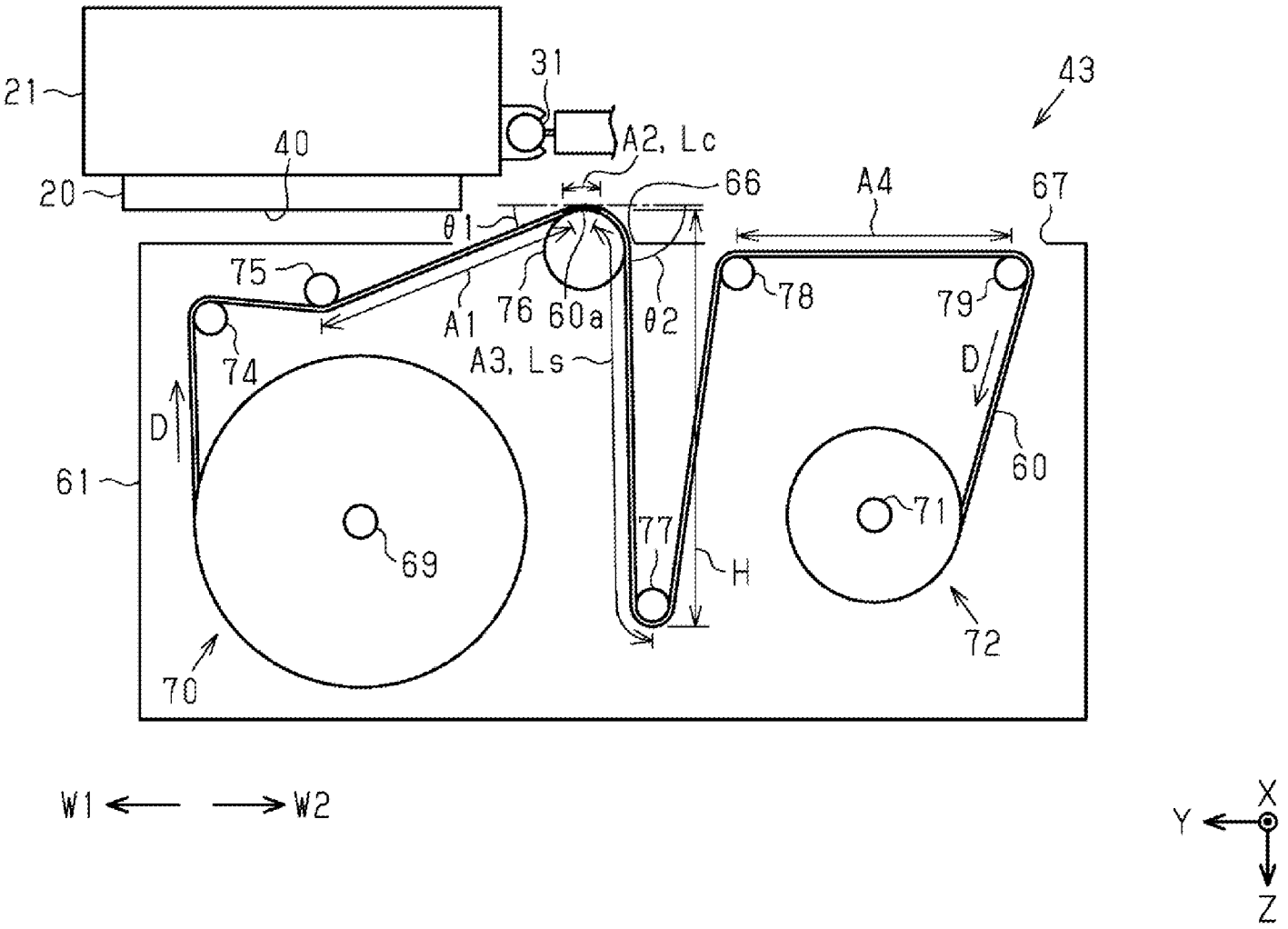
FIG. 4 is a schematic side view of a liquid collection device when a case is located in a standby position.

As illustrated in FIG. 4, the liquid collection device 43 includes an unwinding portion 70 including an unwinding shaft 69, and a winding portion 72 including a winding shaft 71. The unwinding portion 70 holds the band-shaped member 60 wound in a roll shape. The band-shaped member 60 unwound and fed from the unwinding portion 70 is transported to the winding portion 72 along a transport path. The liquid collection device 43 may include an upstream roller 74, a tension roller 75, a pressing portion 76, a regulating roller 77, a first horizontal roller 78, and a second horizontal roller 79 that are provided in order from upstream along the transport path of the band-shaped member 60. The case 61 rotatably supports the unwinding shaft 69, the upstream roller 74, the tension roller 75, the pressing portion 76, the regulating roller 77, the first horizontal roller 78, the second horizontal roller 79, and the winding shaft 71 with the X axis as an axial line direction.

The winding shaft 71 rotates by driving of the winding motor 64. The winding portion 72 winds the band-shaped member 60 around the winding shaft 71 in a roll shape. The winding portion 72 moves a portion of the band-shaped member 60 unwound from the unwinding portion 70 in a movement direction D by winding the band-shaped member 60. The movement direction D is a direction along the transport path of the band-shaped member 60, and is a direction from the unwinding portion 70 located upstream toward the winding portion 72 located downstream.

When the case 61 is located in the standby position, the power transmission mechanism 65 may couple the winding motor 64 to the winding shaft 71, and when the case 61 is separated from the standby position, the power transmission mechanism 65 may uncouple the winding motor 64 from the winding shaft 71. The winding motor 64 may rotate and drive at least one of the winding shaft 71, the upstream roller 74, the tension roller 75, the pressing portion 76, the regulating roller 77, the first horizontal roller 78, and the second horizontal roller 79 together with the winding shaft 71.

The tension roller 75 is disposed upstream of the pressing portion 76 in the movement direction D and below the pressing portion 76 in the gravitational direction Z. The tension roller 75 provides tension to the band-shaped member 60 by pushing the band-shaped member 60 downward.

The pressing portion 76 according to the present exemplary embodiment is a roller around which the band-shaped member 60 is wound. The pressing portion 76 pushes the band-shaped member 60 unwound from the unwinding portion 70 upward from below, and protrudes the band-shaped member 60 from the first opening 66.

The regulating roller 77 is disposed downstream of the pressing portion 76 in the movement direction D and below the pressing portion 76 in the gravitational direction Z. The regulating roller 77 provides tension to the band-shaped member 60 by pushing the band-shaped member 60 downward, and regulates the band-shaped member 60 downward with respect to the pressing portion 76.

The transport path may include an upstream region A1 upstream of the pressing portion 76, a contact region A2 that can cause the band-shaped member 60 to come into contact with the liquid ejecting portion 20, an inclined region A3 in which the band-shaped member 60 is inclined with respect to the horizontal plane, and a horizontal region A4 in which the band-shaped member 60 is substantially horizontally held.

The upstream region A1 is a region from a lowermost portion of the tension roller 75 to an upstream end of the contact region A2. The pressing portion 76 is located downstream of the tension roller 75 in the movement direction D and above the tension roller 75. Thus, the band-shaped member 60 located in the upstream region A1 has an upward slope ascending in a direction opposite to the gravitational direction Z as the band-shaped member 60 moves downstream in the movement direction D. In the present exemplary embodiment, an upstream angle θ1 formed between the horizontal plane indicated by a dash-dot line in FIG. 4 and the band-shaped member 60 located in the upstream region A1 is smaller than 30 degrees. The upstream angle θ1 is an angle formed between a portion of the band-shaped member 60 located in the contact region A2 that is not in contact with the pressing portion 76 and the tension roller 75, and the horizontal plane.

Figure 5:
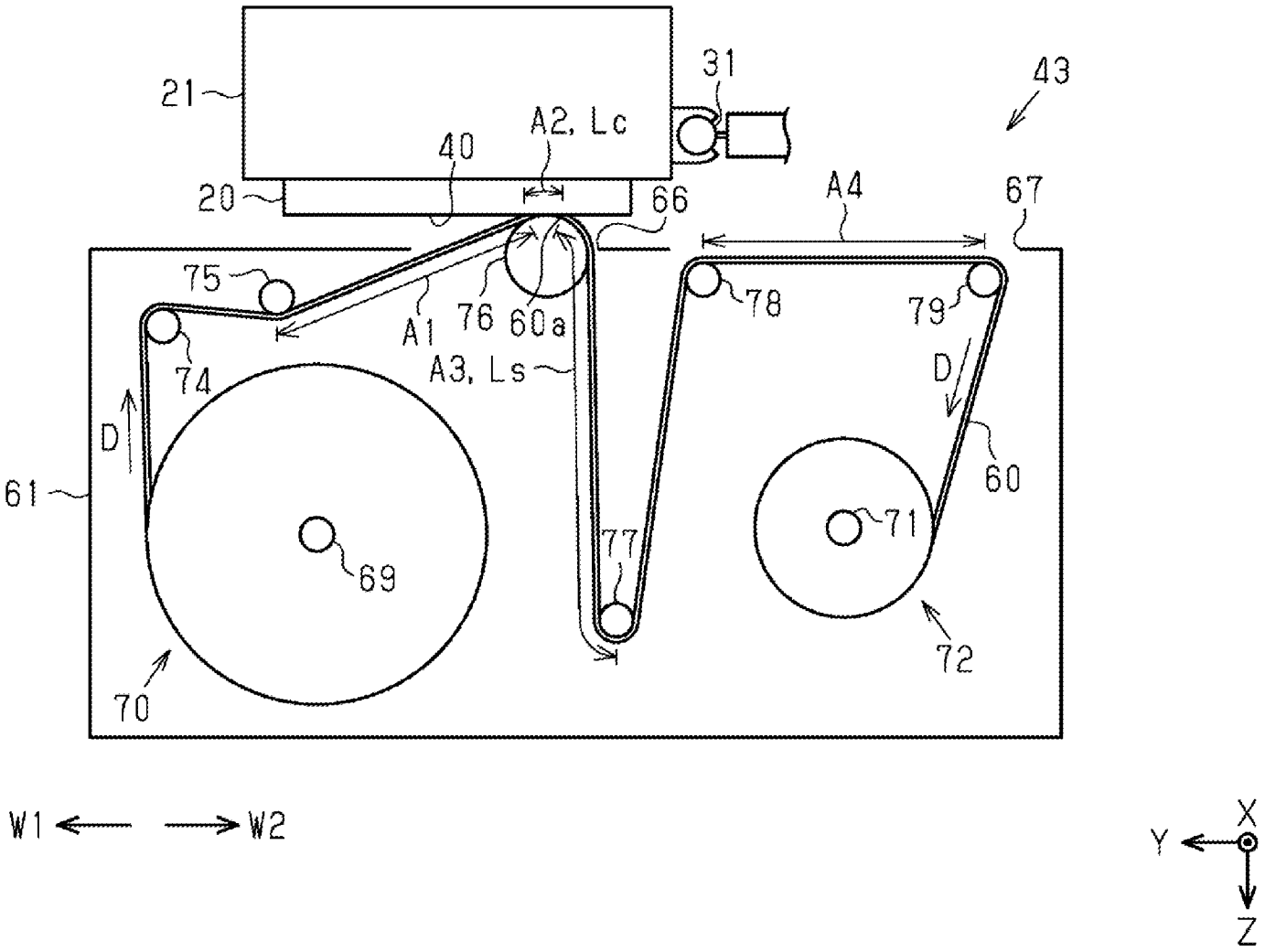
FIG. 5 is a schematic side view of the liquid collection device that performs wiping of the liquid ejecting portion.

As illustrated in FIGS. 4 and 5, the contact region A2 is a region that contacts the liquid ejecting portion 20 when the wiping is performed. The pressing portion 76 can press a contact portion 60*a* located in the contact region A2 of the band-shaped member 60, and can cause the liquid ejecting portion 20 to come into contact with the contact portion 60*a*. In other words, the liquid collection device 43 performs the wiping of the liquid ejecting portion 20 by moving the case 61 with the contact portion 60*a* in contact with the liquid ejecting portion 20. In the drawings, the contact portion 60*a* is illustrated as being filled in black.

As illustrated in FIG. 4, the inclined region A3 is provided downstream of the pressing portion 76 in the movement direction D. The inclined region A3 is a region from a downstream end of the contact region A2 to a lowermost portion of the regulating roller 77 in contact with the band-shaped member 60. The regulating roller 77 is located downstream of the pressing portion 76 in the movement direction D and below the pressing portion 76. Thus, the band-shaped member 60 located in the inclined region A3 has a downward slope descending in the gravitational direction Z as the band-shaped member 60 moves downstream in the movement direction D. In the present exemplary embodiment, a downstream angle θ2 formed between the horizontal plane and the band-shaped member 60 located in the inclined region A3 is greater than 30 degrees. In other words, an inclination, with respect to the horizontal plane, of the band-shaped member 60 directed downstream in the movement direction D and downward in the inclined region A3 is greater than an inclination, with respect to the horizontal plane, of the band-shaped member 60 directed upstream in the movement direction D and downward from the pressing portion 76.

An inclination length Ls of the inclined region A3 in the movement direction D may be set longer than a contact length Lc of the contact portion 60*a* in the movement direction D. A height H of the inclined region A3 in the gravitational direction Z may be set higher than a height at which the band-shaped member 60 sucks up a liquid in the gravitational direction Z. The inclined region A3 may have a volume in which a liquid attached to the contact portion 60*a* can be absorbed and held.

The horizontal region A4 is a region from an uppermost portion of the first horizontal roller 78 to an uppermost portion of the second horizontal roller 79. The first horizontal roller 78 and the second horizontal roller 79 are provided at the same height in the gravitational direction Z, and keep the band-shaped member 60 located in the horizontal region A4 substantially horizontal. The horizontal region A4 is located below the second opening 67, and the band-shaped member 60 located in the horizontal region A4 is exposed from the second opening 67.

Figure 6:
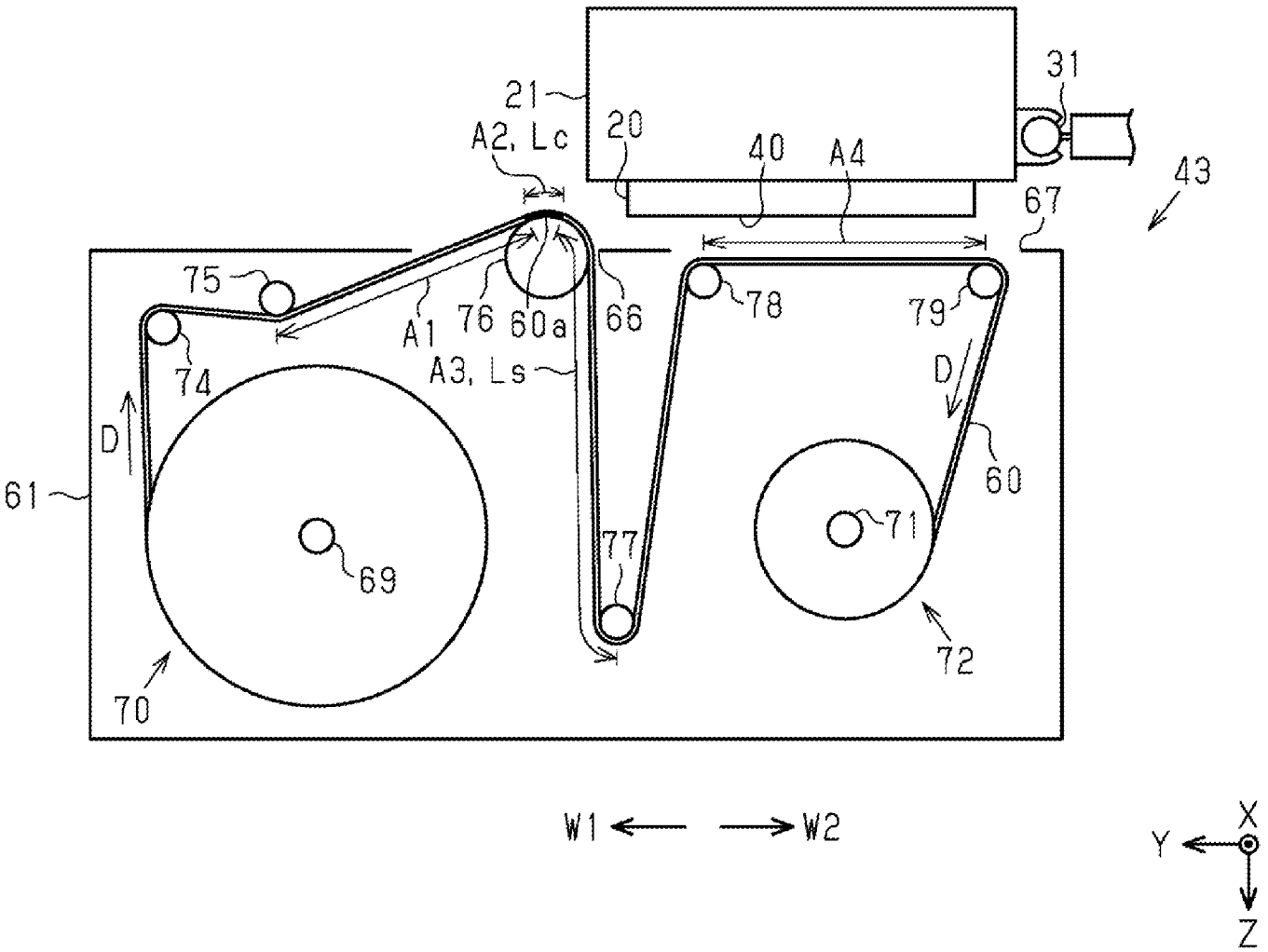
FIG. 6 is a schematic side view of the liquid collection device when the case is located in an accommodation position.

As illustrated in FIG. 6, when the case 61 is located in the accommodation position and the liquid ejecting portion 20 is located in the cleaning position CP, the band-shaped member 60 in the horizontal region A4 faces the nozzle surface 40. In this state, the liquid ejecting apparatus 11 may perform pressure cleaning that emits a pressurized liquid from the nozzles 36. In other words, the liquid collection device 43 may accommodate the liquid emitted by the pressure cleaning.

Next, actions of the present exemplary embodiment will be described.

First, a case in which the control portion 29 performs the suction cleaning, the wiping, and the flushing in order as maintenance of the liquid ejecting portion 20 will be described. Hereinafter, the maintenance performed in this order is also referred to as first maintenance.

Figure 8:
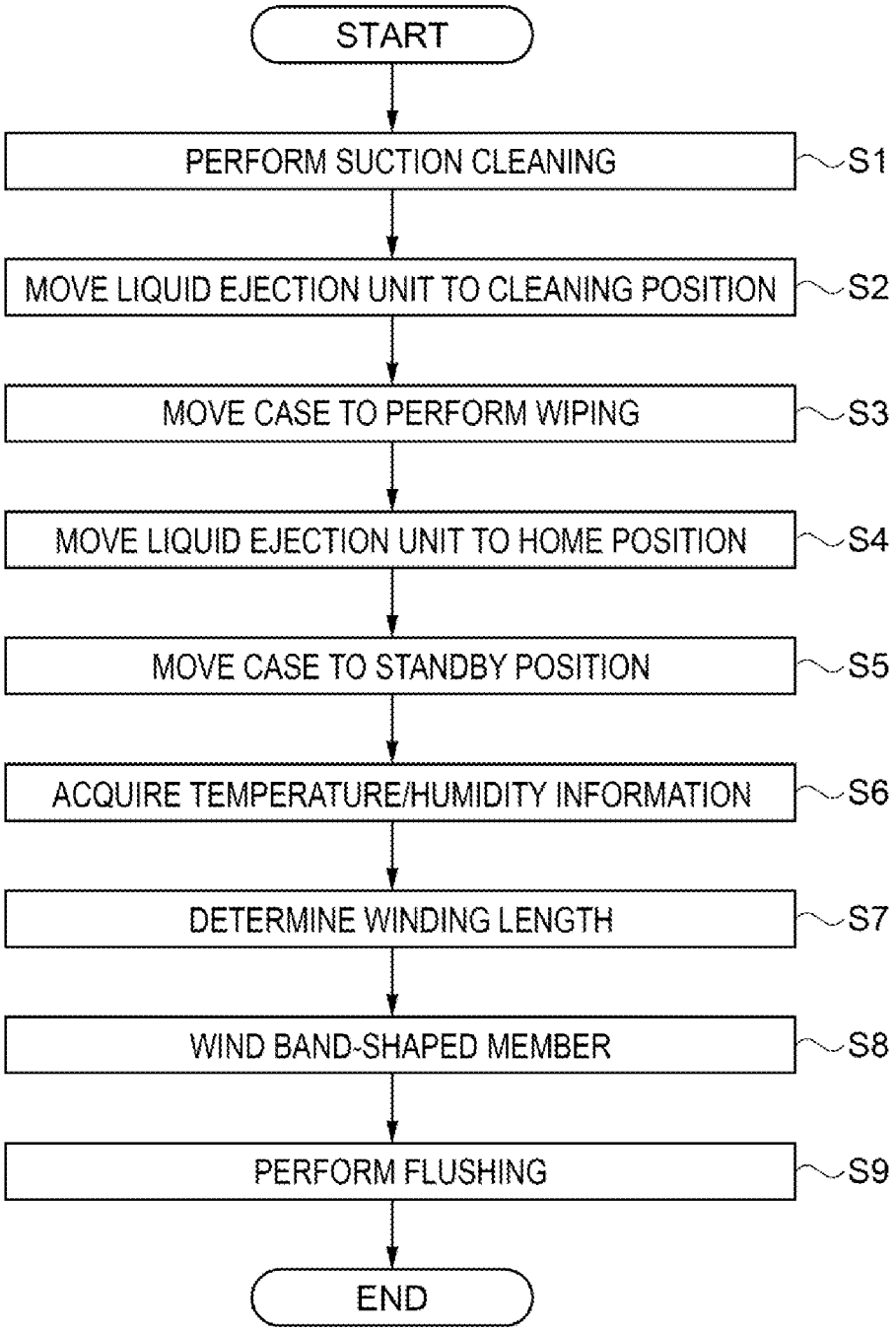
FIG. 8 is a flowchart illustrating an operation of first maintenance.

FIG. 8 is a flowchart illustrating an operation of the first maintenance.

The control portion 29 stops the liquid ejecting portion 20 above the suction device 44, and performs the suction cleaning on a nozzle group that requires the suction cleaning (step S1). When the suction cleaning ends, the control portion 29 moves the liquid ejecting portion 20 to the cleaning position CP (step S2).

As illustrated in FIG. 4, the control portion 29 drives the wiping motor 63 in a normal rotation with the case 61 located in the standby position, and moves the case 61 in the first wiping direction W1 to perform the wiping (step S3).

As illustrated in FIG. 5, the liquid collection device 43 causes the contact portion 60*a* to come into contact with the liquid ejecting portion 20 to wipe the liquid ejecting portion 20. Specifically, the liquid collection device 43 performs the wiping by moving the case 61 while the pressing portion 76 presses the band-shaped member 60 against the nozzle surface 40 and the band-shaped member 60 is sandwiched between the pressing portion 76 and the nozzle surface 40.

As illustrated in FIG. 6, when the case 61 moves to the accommodation position, the control portion 29 stops driving of the wiping motor 63, and also moves the liquid ejecting portion 20 to the home position HP (step S4). Subsequently, the control portion 29 drives the wiping motor 63 in a reverse rotation, moves the case 61 in the second wiping direction W2, and returns the case 61 to the standby position (step S5).

Next, the control portion 29 acquires temperature/humidity information from the temperature/humidity sensor 28 (step S6), and determines a winding length of the band-shaped member 60 based on the acquired temperature/humidity information (step S7). In the present exemplary embodiment, the control portion 29 determines a winding length according to a table T stored in the memory in the control portion 29. As illustrated in FIG. 9, winding lengths B1 to B9 (mm) according to three temperature ranges and three humidity ranges are predetermined and stored in the table T. These are values determined based on a result of an evaluation performed in advance.

A liquid absorbed in the band-shaped member 60 by the wiping spreads inside the band-shaped member 60. Then, when the liquid is ink, a color component also spreads along with a solvent component of the ink that spreads inside the band-shaped member 60. When the contact portion 60*a* is located in the contact region A2, the liquid easily spreads toward the inclined region A3 having a large inclination with respect to the contact region A2 due to an effect of gravity, but also spreads to the upstream region A1 having a low inclination with respect to the contact region A2. The upstream region A1 is a region used in next wiping, and thus it is necessary to wind the band-shaped member 60 by a length in consideration of spread of the liquid.

In the band-shaped member 60, a range in which the liquid spreads varies depending on the temperature and humidity inside the liquid ejecting apparatus 11. Specifically, under a condition where the temperature is the same, the amount of water vapor that can be held in the air is greater at lower humidity, and thus the liquid absorbed in the band-shaped member 60 easily evaporates. In other words, at lower humidity, a speed at which the liquid spreading inside the band-shaped member 60 decreases is faster, and a length at which the liquid spreads to the upstream region A1 is shorter. Thus, in the table T, when a temperature range is the same, at lower humidity, a winding length is shorter, specifically, a winding length is set so as to satisfy B1<B4<B7, B2<B5<B8, and B3<B6<B9. In other words, provided that the humidity detected by the temperature/humidity sensor 28 is a first humidity, in this case, a winding length is shorter than that when the temperature is the same and the humidity is a second humidity higher than the first humidity.

Further, under a condition where humidity is the same, viscosity of the liquid absorbed in the band-shaped member 60 is higher at a lower temperature, and thus a speed at which the liquid spreads inside the band-shaped member 60 is slow, and a length at which the liquid spreads to the upstream region A1 is short. Thus, in the table T, when a humidity range is the same, at lower temperature, a winding length is shorter, specifically, a winding length is set so as to satisfy B1<B2<B3, B4<B5<B6, and B7<B8<B9. In other words, provided that the temperature detected by the temperature/humidity sensor 28 is first temperature, in this case, a winding length is shorter than that when the humidity is the same and the temperature is second temperature higher than the first temperature.

Figure 7:
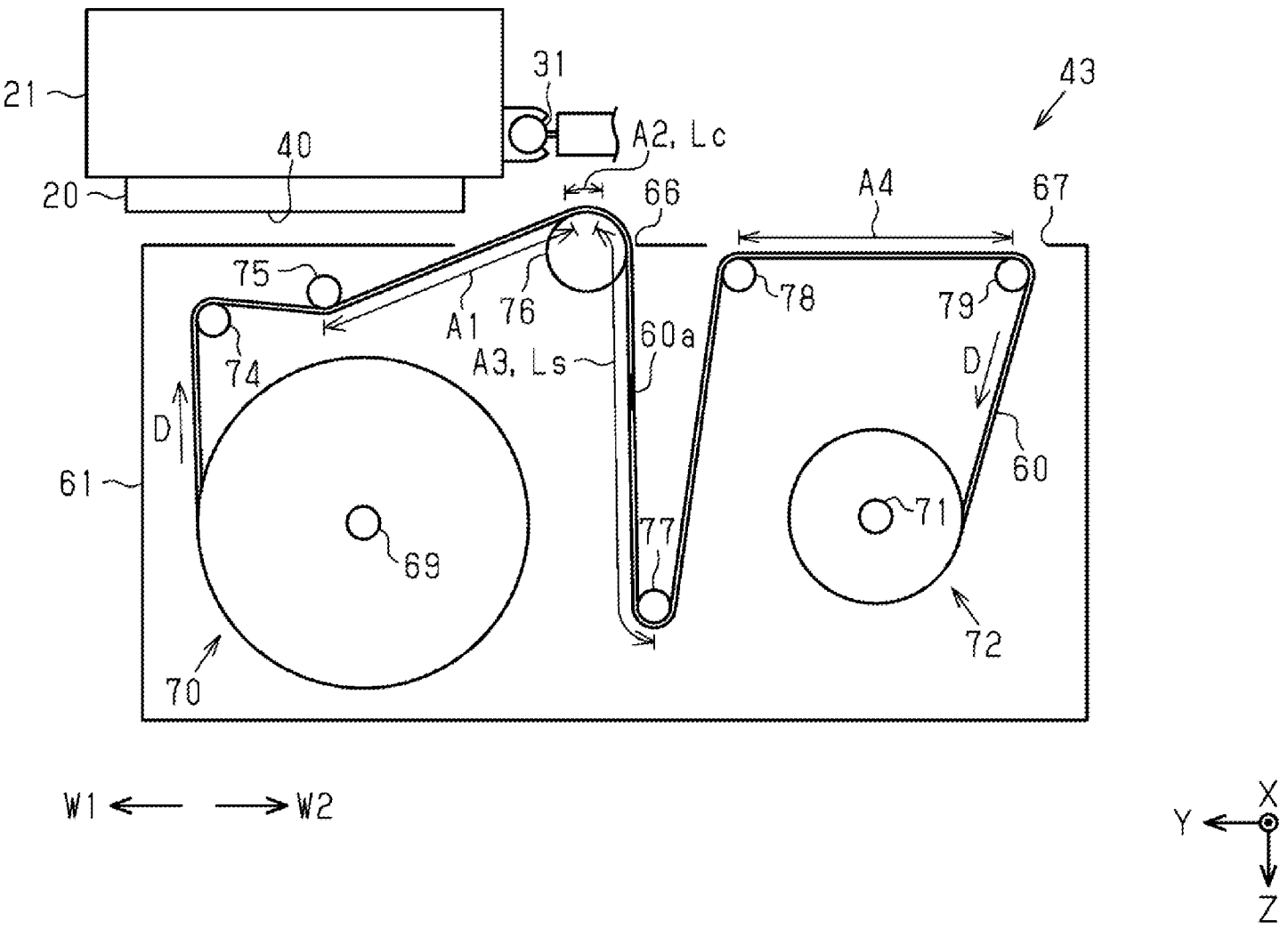
FIG. 7 is a schematic side view of the liquid collection device when a band-shaped member is wound up.

Subsequently, the control portion 29 drives the winding motor 64 such that the band-shaped member 60 is wound by the winding portion 72 by a determined winding length (step S8). As illustrated in FIG. 7, the contact portion 60*a* moves in the movement direction D by winding the band-shaped member 60 by the winding portion 72.

When the wiping ends, the control portion 29 moves the liquid ejecting portion 20 above the liquid accommodation portion 47, and performs the flushing that ejects a liquid from the liquid ejecting portion 20 at a timing at which the liquid ejecting portion 20 passes above the liquid accommodation portion 47 (step S9). In this way, the first maintenance ends.

Next, a case in which the control portion 29 performs the pressure cleaning, the wiping, and the flushing in order as maintenance of the liquid ejecting apparatus 11 will be described. Hereinafter, the maintenance performed in this order is also referred to as second maintenance. Note that, in the second maintenance according to the present exemplary embodiment, the wiping by the band-shaped member 60 is performed twice.

Figure 10:
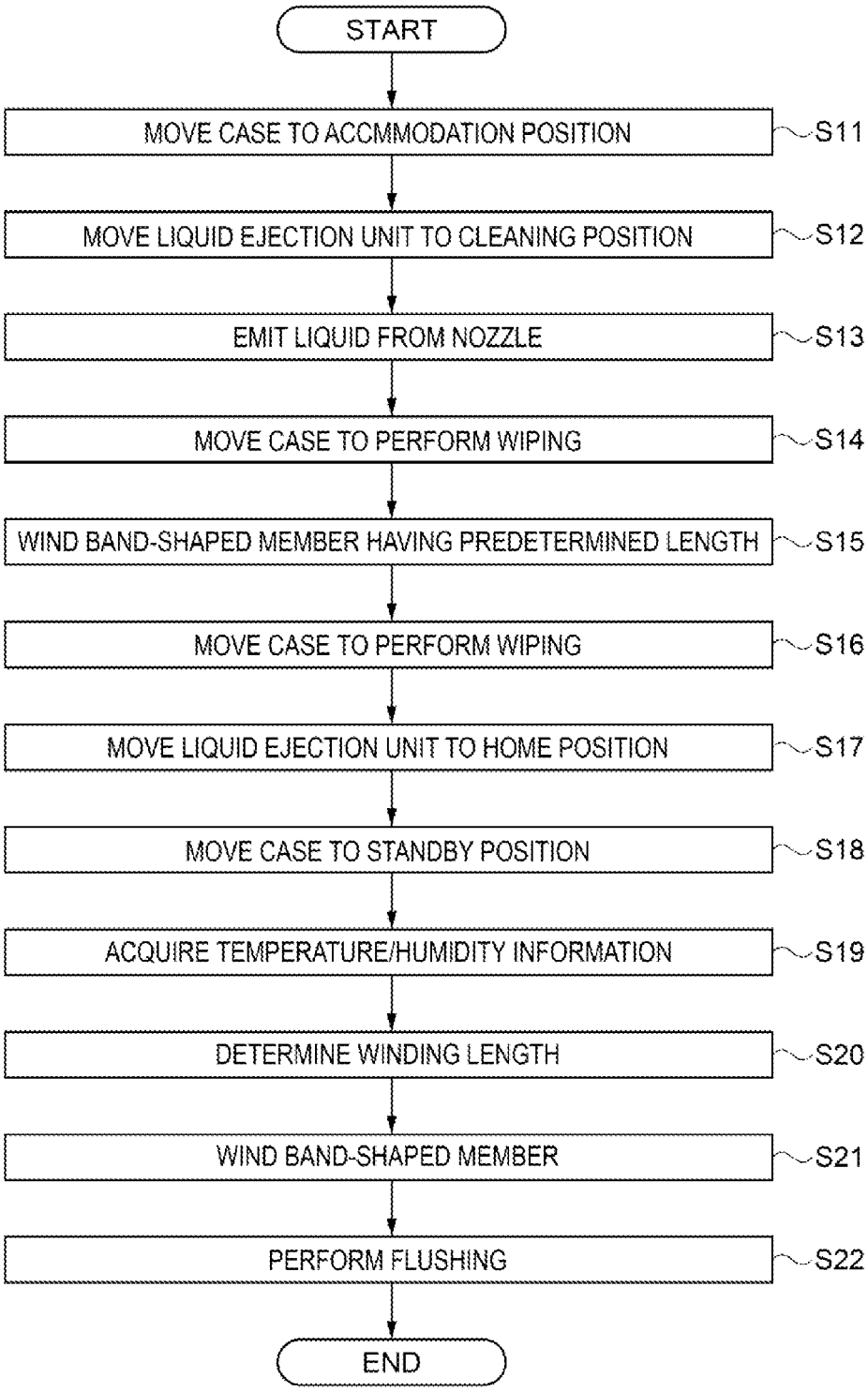
FIG. 10 is a flowchart illustrating an operation of second maintenance.

FIG. 10 is a flowchart illustrating an operation of the second maintenance.

As illustrated in FIGS. 3 and 6, when the control portion 29 performs the pressure cleaning, the control portion 29 moves the case 61 to the accommodation position and stops the case 61 (step S11). Subsequently, the control portion 29 moves the liquid ejecting portion 20 to the cleaning position CP and stops the liquid ejecting portion 20 (step S12).

The control portion 29 controls the liquid supply device 23, supplies a pressurized liquid to the nozzles 36, and emits the liquid from the nozzles 36 (step S13). The liquid emitted from the nozzles 36 remains so as to be wet and spread on the nozzle surface 40. When the amount of the liquid remaining on the nozzle surface 40 increases, the liquid drips from the nozzle surface 40. At this time, the band-shaped member 60 is located directly below the nozzles 36. Thus, in the pressure cleaning, the band-shaped member 60 located in the horizontal region A4 accommodates the liquid remaining on the nozzle surface 40.

As illustrated in FIG. 5, after the control portion 29 performs the pressure cleaning, the control portion 29 drives the wiping motor 63 in a reverse rotation while stopping the liquid ejecting portion 20, and moves the case 61 to the standby position in the second wiping direction W2. In other words, the control portion 29 performs first wiping by the band-shaped member 60 (step S14), and wipes, by the pressure cleaning, the liquid emitted and remaining on the nozzle surface 40.

After the wiping, the control portion 29 drives the winding motor 64 and winds the band-shaped member 60 (step S15). Note that second wiping immediately follows, and thus a winding length herein is a predetermined length determined in advance.

Then, the control portion 29 drives the wiping motor 63 in a normal rotation with the case 61 located in the standby position, and moves the case 61 in the first wiping direction W1 to perform the second wiping (step S16), and the case 61 moves to the accommodation position as illustrated in FIG. 6.

The control portion 29 stops driving of the wiping motor 63, and moves the liquid ejecting portion 20 to the home position HP (step S17). Then, the control portion 29 drives the wiping motor 63 in a reverse rotation, moves the case 61 in the second wiping direction W2, and returns the case 61 to the standby position (step S18).

Subsequently, the control portion 29 acquires the temperature/humidity information from the temperature/humidity sensor 28 (step S19), and determines a winding length of the band-shaped member 60 according to the table (not illustrated) stored in the memory in the control portion 29 based on the acquired temperature/humidity information (step S20). Note that the table used here is not the same as the table T used in the first maintenance, and a winding length suitable for the wiping in the second maintenance is determined in advance and stored in the table. Note that a size relationship of the winding length in each temperature range and each humidity range is the same as that of the table T.

Subsequently, the control portion 29 drives the winding motor 64 such that the band-shaped member 60 is wound by the determined winding length (step S21).

Then, the control portion 29 moves the liquid ejecting portion 20 onto the liquid accommodation portion 47, and performs the flushing (step S22). In this way, the second maintenance ends.

When the amount of the liquid attached to the contact portion 60*a* is great, the control portion 29 may increase a length of the band-shaped member 60 to be wound by the winding portion 72 after the band-shaped member 60 is in contact with the liquid ejecting portion 20 as compared to a case in which the amount of the liquid attached to the contact portion 60*a* is small. In other words, the amount of the liquid attached to the nozzle surface 40 by the pressure cleaning is greater than the amount attached to the nozzle surface 40 by the suction cleaning. Thus, the control portion 29 may increase a length of the band-shaped member 60 wound due to the wiping in the second maintenance as compared to a length of the band-shaped member 60 wound due to the wiping in the first maintenance.

As described above, according to the present exemplary embodiment, the control portion 29 determines a winding length of the band-shaped member 60 after the wiping, based on temperature and humidity detected by the temperature/humidity sensor 28. Specifically, when a temperature range is the same, the control portion 29 shortens a winding length at lower humidity, and when a humidity range is the same, the control portion 29 shortens a winding length at a lower temperature. In this way, since an appropriate winding length is determined based on the temperature and humidity, excess winding of the band-shaped member 60 can be suppressed. Further, time required for the winding, that is, the time required for the maintenance can be accordingly reduced.

The present exemplary embodiment described above may be modified as follows. The present exemplary embodiment and modified examples thereof to be described below may be implemented in combination within a range in which a technical contradiction does not arise.

Figure 11:
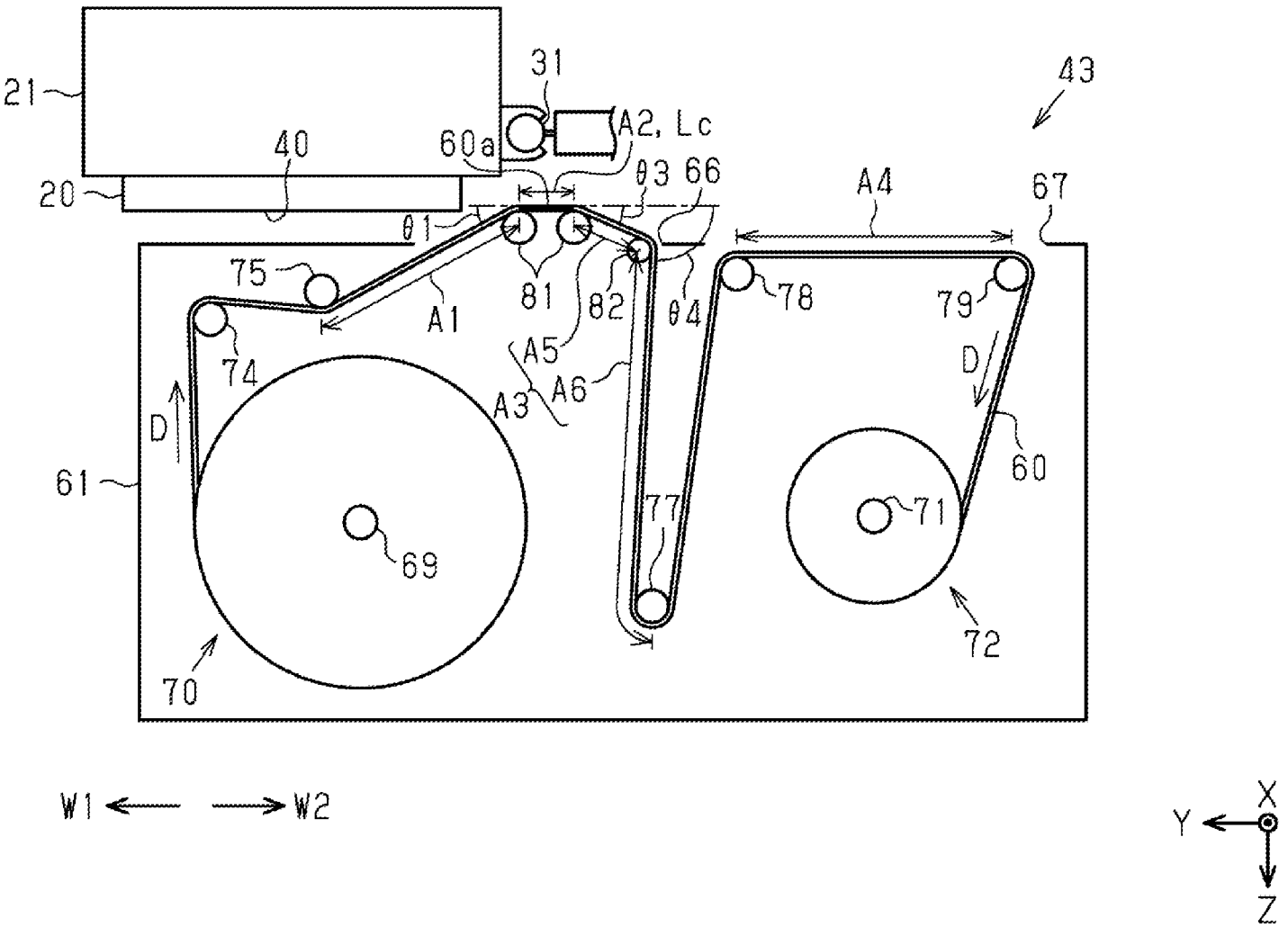
FIG. 11 is a schematic side view of a liquid collection device according to a first modified example.

As in a first modified example illustrated in FIG. 11, the pressing unit may be constituted by a plurality of press rollers 81. When the liquid collection device 43 includes the two press rollers 81, the contact region A2 is located between upper end portions of the press rollers 81. The liquid collection device 43 may include a downstream roller 82 provided between the press roller 81 and the regulating roller 77 on the transport path of the band-shaped member 60. The inclined region A3 may include a gentle inclined region A5 having a gentle inclination, and a steep inclined region A6 having a steep inclination. Specifically, in the movement direction D, the gentle inclined region A5 is located from a downstream end of the contact region A2 to the downstream roller 82. In the movement direction D, the steep inclined region A6 is located from the downstream roller 82 to a lowermost portion of the regulating roller 77. The steep inclined region A6 is located downstream of the gentle inclined region A5 in the movement direction D. A gentle angle θ3 formed between the horizontal plane and the band-shaped member 60 located in the gentle inclined region A5 may be smaller than 30 degrees, or may be the same as the upstream angle θ1. Provided that the gentle angle 03 and the upstream angle θ1 are the same, the nozzle surface 40 can be wiped in a similar manner in the wiping that moves the case 61 in the first wiping direction W1, and the wiping that moves the case 61 in the second wiping direction W2. A steep angle θ4 formed between the horizontal plane and the band-shaped member 60 located in the steep inclined region A6 may be greater than the upstream angle θ1 and the gentle angle θ3, and equal to or greater than the downstream angle θ2. In other words, the inclination of the band-shaped member 60 downstream and downward in the movement direction D in the steep inclined region A6 is greater than the inclination of the band-shaped member 60 upstream and downward in the movement direction D in the upstream region A1. After the control portion 29 performs the wiping by causing the contact portion 60*a* to come into contact with the liquid ejecting portion 20, the winding portion 72 may wind the band-shaped member 60 by a length longer than a total length of the contact length Lc of the band-shaped member 60 and a length of the gentle inclined region A5 in the movement direction D. In other words, the control portion 29 may move, to the steep inclined region A6, the contact portion 60*a* that absorbs the liquid due to the wiping.

Figure 12:
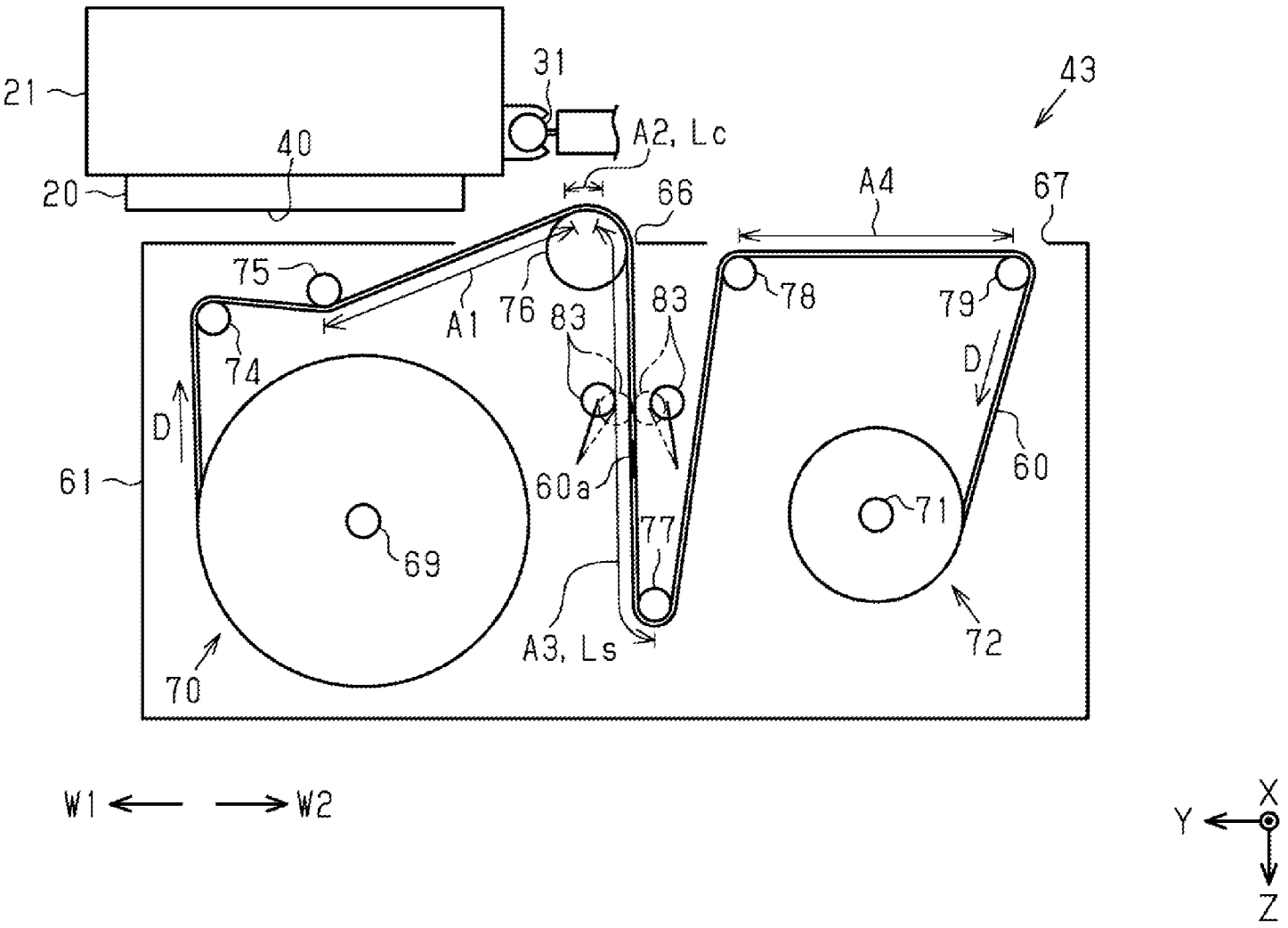
FIG. 12 is a schematic side view of a liquid collection device according to a second modified example.

As in a second modified example illustrated in FIG. 12, the liquid collection device 43 may include nip rollers 83 that sandwich the band-shaped member 60. The control portion 29 may wind the band-shaped member 60 with the pair of nip rollers 83 located in a release position indicated by a solid line in FIG. 12, and the pair of nip rollers 83 may be located in a nip position indicated by a double-dashed line in FIG. 12 after the contact portion 60*a* passes through the nip rollers 83. By sandwiching the band-shaped member 60 by the nip rollers 83, a risk that the liquid held in the contact portion 60*a* spreads upstream of the nip rollers 83 can be reduced. Therefore, for example, the band-shaped member 60 may have a volume in the inclined region A3 smaller than a volume in which the liquid attached to the contact portion 60*a* can be absorbed and held. The height H of the inclined region A3 in the gravitational direction Z may be lower than the height at which the band-shaped member 60 sucks up the liquid in the gravitational direction Z. Even in such a case, a risk that the liquid attached to the contact portion 60*a* moved to the inclined region A3 spreads to the contact region A2 can be reduced.

Figure 13:
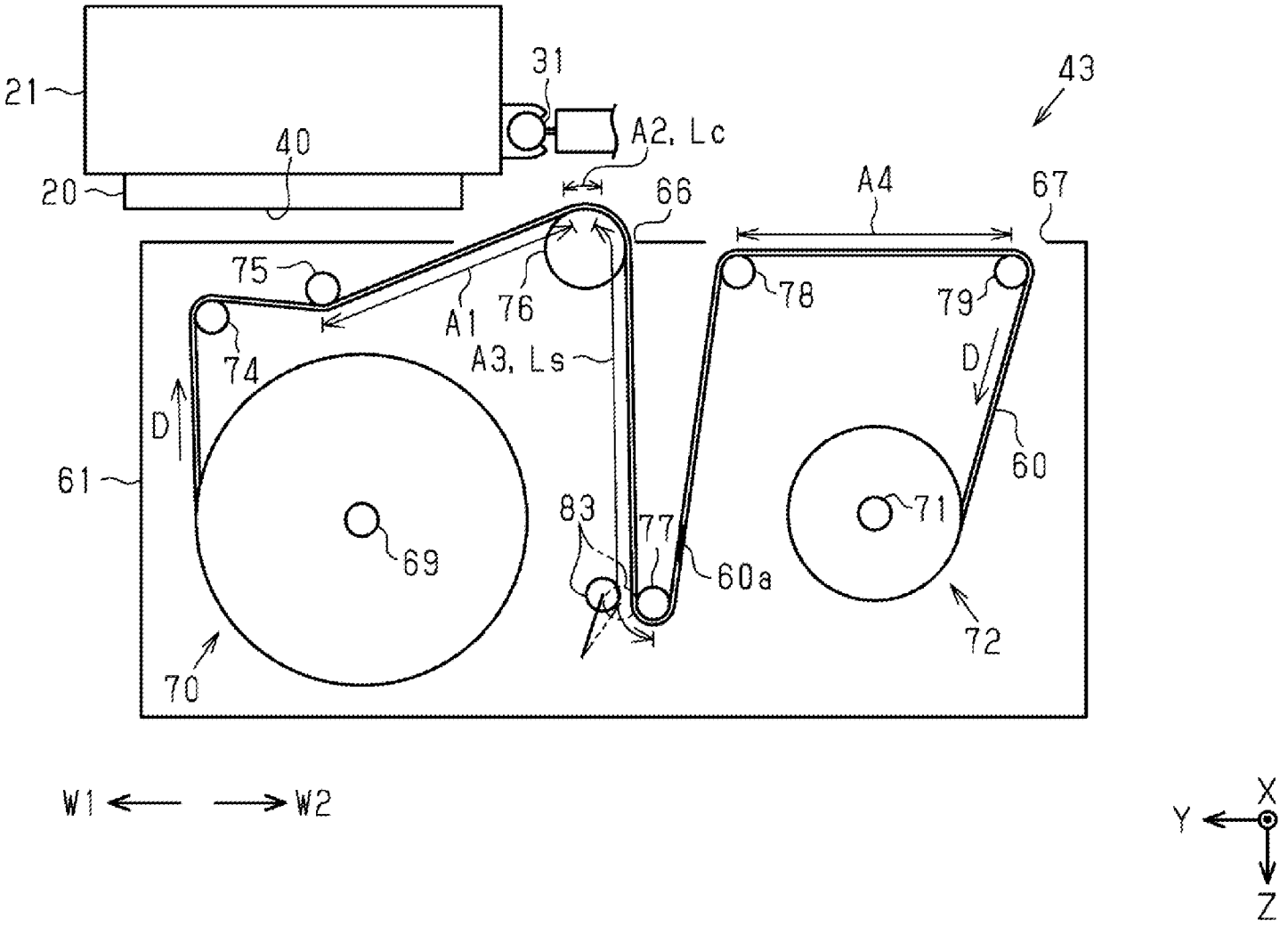
FIG. 13 is a schematic side view of a liquid collection device according to a third modified example.

As in a third modified example illustrated in FIG. 13, the band-shaped member 60 may be sandwiched between the nip roller 83 and the regulating roller 77. The control portion 29 may wind the band-shaped member 60 with the nip roller 83 located in a release position indicated by a solid line in FIG. 13, and the nip roller 83 may be located in a nip position indicated by a double-dashed line in FIG. 13 after the contact portion 60*a* passes through the inclined region A3.

The band-shaped member 60 located in the inclined region A3 may be sandwiched between the nip roller 83 and the pressing portion 76. The control portion 29 may cause the band-shaped member 60 to be wound with the nip roller 83 located in a release position, and after the contact portion 60*a* moves to the inclined region A3, the nip roller 83 may be located in a nip position and the band-shaped member 60 may be sandwiched between the pressing portion 76 and the nip roller 83.

The liquid collection device 43 may be configured to wind the band-shaped member 60 in the accommodation position.

When elapsed time since the band-shaped member 60 starts wiping until next wiping cannot be estimated, the control portion 29 may cause the band-shaped member 60 having a certain length to be wound. In this case, in a use environment of the liquid ejecting apparatus 11, a total length of a maximum spread length from the contact region A2 to a direction opposite to the movement direction D on the unwinding portion 70 side when maximum elapsed time since the liquid is attached to the contact portion 60*a* until spread of the liquid in the band-shaped member 60 stops elapses and a spread range is the largest, and the contact length Lc may be set to a certain length. For example, in the wiping performed after the cleaning, the wiping to the first wiping direction W1 by the band-shaped member 60 is assumed to be continuously performed twice. Then, when elapsed time since the first wiping starts until the second wiping is shorter than the maximum elapsed time, and elapsed time since the second wiping starts until next wiping cannot be estimated, the control portion 29 may set a length of the band-shaped member 60 wound due to the first wiping to be shorter than a certain length that is a length of the band-shaped member 60 wound due to the second wiping.

For example, when the liquid is ink, a color component of the ink absorbed in a wet band-shaped member 60 has longer spread time in the band-shaped member 60 and a larger spread range than those of a color component of the ink absorbed in a dry band-shaped member 60. Thus, when a wiping liquid supply mechanism capable of supplying a liquid for the wiping to the band-shaped member 60 is provided, the control portion 29 may set a length of the band-shaped member 60 wound due to the wiping by the band-shaped member 60 supplied with a wiping liquid to be longer than a length of the band-shaped member 60 wound due to the wiping by the band-shaped member 60 without being supplied with the wiping liquid.

In the wiping, the liquid collected from the nozzle surface 40 is collected in the contact region A2 and a region in front of the contact region A2 in the wiping direction. Further, the liquid absorbed in the band-shaped member 60 does not easily spread from a region in which the band-shaped member 60 is sandwiched between the pressing portion 76 and the nozzle surface 40 to a region in which the band-shaped member 60 is not sandwiched between the pressing portion 76 and the nozzle surface 40. Thus, the control portion 29 may set a length of the band-shaped member 60 wound due to the wiping in which a front side in the wiping direction is an unwinding side of the band-shaped member 60 to be longer than a length of the band-shaped member 60 wound due to the wiping in which the front side in the wiping direction is a winding side of the band-shaped member 60.

The liquid collection device 43 may perform the wiping after the band-shaped member 60 is wound. In this case, the band-shaped member 60 may not be wound after the wiping is performed. When the band-shaped member 60 is wound before the wiping, the control portion 29 may change the amount of the band-shaped member 60 being wound, based on elapsed time since previous wiping.

The amount of the liquid attached to the nozzle surface 40 by the suction cleaning is greater as the number of nozzle groups that perform the suction cleaning is greater. Thus, when the control portion 29 performs the suction cleaning on all the nozzle groups, the control portion 29 may set a length of the band-shaped member 60 being wound to be longer than that when the control portion 29 performs the suction cleaning on one nozzle group.

The control portion 29 may perform a winding operation of the band-shaped member 60 for a plurality of times between time at which the wiping is performed and time at which next wiping is performed. In this case, a length of the band-shaped member 60 wound by one winding operation may be set shorter than the contact length Lc. For example, after the wiping is performed with the contact portion 60*a* in contact with the liquid ejecting portion 20, the control portion 29 may cause the band-shaped member 60 to be wound by a length from an upstream end of the contact portion 60*a* to an uppermost portion of the pressing portion 76, and may further cause the band-shaped member 60 to be wound before the next wiping is performed. The upstream end of the contact portion 60*a* is located downstream of the uppermost portion of the pressing portion 76 by the winding operation after previous wiping. Thus, spread of the liquid directed to the upstream side in the movement direction D due to the effect of gravity can be reduced, and a portion of the band-shaped member 60 without adhesion of the liquid can be easily located in the contact region A2 by the winding operation performed before subsequent wiping.

The inclination length Ls of the inclined region A3 in the movement direction D may be set the same as or shorter than the contact length Lc of the contact portion 60*a* in the movement direction D. In this case, the control portion 29 may cause the band-shaped member 60 to be wound such that at least a part of the contact portion 60*a* passes through the inclined region A3.

The liquid collection device 43 may be configured not to include the regulating roller 77. For example, the inclined region A3 may be a region hanging downstream in the movement direction D from the pressing portion 76.

The temperature/humidity information is not limited to information acquired from the temperature/humidity sensor 28. For example, the temperature/humidity information may be input from an external apparatus via an interface (not illustrated), or a user may input the temperature/humidity information from the operation panel 24. In these cases, the above-described interface and the operating panel 24 correspond to the temperature/humidity information acquisition portion. Further, the temperature and humidity may be acquired through different paths.

A winding length is determined by using the table T, but the present disclosure is not limited to the configuration. For example, the present disclosure may be configured to substitute acquired temperature/humidity information into a predetermined computational expression each time to calculate a winding length.

A winding length is determined based on two parameters of a temperature range and a humidity range, but the present disclosure is not limited to the configuration. For example, the present disclosure may be configured to determine a winding length based on three or more parameters such as a temperature range, a humidity range, and elapsed time. Note that a range in which the liquid wiped by the band-shaped member 60 spreads inside the band-shaped member 60 increases as time goes by. Thus, provided that elapsed time is a parameter, a winding length may be set longer with longer elapsed time.

Provided that accurate temperature/humidity information cannot be acquired due to a failure and the like of the temperature/humidity sensor 28, that is, when either temperature or humidity is unknown, the control portion 29 may determine the winding length to be a predetermined length set in advance. This length may be set to a length such that the wiping can be performed in a portion without spread of the liquid regardless of a temperature/humidity environment.

The liquid ejecting apparatus 11 may be a liquid ejecting apparatus that ejects or discharges a liquid other than ink. It is assumed that a state of the liquid discharged as a small amount of a liquid droplet from the liquid ejecting apparatus includes a trail in a particle shape, an eyedrop shape, and a string shape. The liquid herein may be a material that can be ejected from the liquid ejecting apparatus. For example, the liquid may be in a state when a substance is in a liquid phase, and is assumed to include a fluid such as a liquid with high or low viscosity, sol, gel water, the other inorganic solvent, an organic solvent, a solution, a liquid resin, a liquid metal, and a metallic melt. The liquid is assumed to include not only a liquid as a state of a substance, but also a liquid and the like in which a particle of a functional material formed of a solid material such as a pigment and a metallic particle is dissolved, dispersed, or mixed in a solvent. A representative example of the liquid includes ink, a liquid crystal, and the like described in the exemplary embodiment described above. Here, the ink is assumed to include various liquid constituents such as general aqueous ink and solvent ink, a gel ink, and a hot-melt ink. For example, a specific example of the liquid ejecting apparatus is a device that ejects a liquid including a material such as an electrode material and a color material used in manufacture and the like of a liquid crystal display, an electroluminescent display, a surface emitting display, and a color filter in a dispersed or dissolved form. The liquid ejecting apparatus may be a device that ejects a bioorganic substance used for biochip manufacturing, a device that is used as a precision pipette and ejects a liquid to be a sample, a printing device, a micro dispenser, and the like. The liquid ejecting apparatus may be a device that ejects a lubricant to a precision machine such as a watch and a camera in a pinpoint manner, and a device that ejects a transparent resin liquid such as an ultraviolet cure resin onto a substrate for forming a tiny hemispherical lens, an optical lens, and the like used for an optical communication element and the like. The liquid ejecting apparatus may be a device that ejects an etching liquid such as an acid or an alkali for etching a substrate and the like.

What is claimed is:

1. A liquid ejecting apparatus, comprising:

a liquid ejecting portion configured to eject a liquid;

a wiping portion including a band-shaped member configured to come into contact with the liquid ejecting portion to wipe a liquid attached to the liquid ejecting portion, and a winding portion configured to wind up the band-shaped member;

a temperature/humidity information acquisition portion configured to acquire temperature/humidity information related to a temperature and a humidity around the wiping portion; and a control portion configured to cause the band-shaped member to come into contact with the liquid ejecting portion to wipe the liquid, and then cause the winding portion to wind up the band-shaped member, wherein the control portion determines, based on the temperature/humidity information acquired by the temperature/humidity information acquisition portion, a winding length of the band-shaped member wound by the winding portion after the band-shaped member wipes the liquid.

2. The liquid ejecting apparatus according to claim 1, wherein assuming the temperature is constant, the control portion sets the winding length shorter when the humidity acquired by the temperature/humidity information acquisition portion is a first humidity than when the humidity acquired by the temperature/humidity information acquisition portion is a second humidity higher than the first humidity.

3. The liquid ejecting apparatus according to claim 1, wherein assuming the humidity is constant, the control portion sets the winding length shorter when the temperature acquired by the temperature/humidity information acquisition portion is a first temperature than when the temperature acquired by the temperature/humidity information acquisition portion is a second temperature higher than the first temperature.

4. The liquid ejecting apparatus according to claim 1, wherein when either temperature or humidity is unknown, the control portion determines the winding length to be a predetermined length set in advance.

5. The liquid ejecting apparatus according to claim 1, wherein the temperature/humidity information acquisition portion is a temperature/humidity sensor configured to detect the temperature and the humidity.

6. A method for controlling a liquid ejecting apparatus including a liquid ejecting portion configured to eject a liquid, a wiping portion including a band-shaped member configured to come into contact with the liquid ejecting portion to wipe a liquid attached to the liquid ejecting portion, and a winding portion configured to wind up the band-shaped member, and a temperature/humidity information acquisition portion configured to acquire temperature/humidity information related to a temperature and a humidity around the wiping portion, the liquid ejecting apparatus being configured to cause the band-shaped member to come into contact with the liquid ejecting portion to perform wiping, and then cause the winding portion to wind up the band-shaped member, the method comprising:

determining, based on the temperature/humidity information acquired by the temperature/humidity information acquisition portion, a winding length of the band-shaped member wound by the winding portion after the band-shaped member wipes the liquid.

* * * * *